United States Patent [19]

Lam

[11] Patent Number: 4,575,096

[45] Date of Patent: Mar. 11, 1986

[54] GAME PIECES FORMING UNIQUE PLAYING UNITS

[76] Inventor: Roger K. Lam, 11889 Dogwood Ave., Fountain Valley, Calif. 92708

[21] Appl. No.: 621,853

[22] Filed: Jun. 18, 1984

Related U.S. Application Data

[63] Continuation-in-part of Ser. No. 439,179, Jan. 7, 1983, Pat. No. 4,488,727.

[51] Int. Cl.[4] ..... A63F 3/00

[52] U.S. Cl. ..... 273/296

[58] Field of Search ..... 273/288, 290, 236, 242, 273/273, 296, 305, 303, 304, 255, 262

[56] References Cited

U.S. PATENT DOCUMENTS 2,574,328 11/1951 Hartley ..... 273/296

4,227,698 10/1980 Ishizuki ..... 273/303

4,428,582 1/1984 Smith ..... 273/296

*Primary Examiner*—Richard C. Pinkham

*Assistant Examiner*—Matthew L. Schneider

*Attorney, Agent, or Firm*—Allen A. Dicke, Jr.

[57] ABSTRACT

Game apparatus comprises a plurality of playing pieces each coded to indicate its attribute and value. The attribute of each piece is one of three possible attributes and the value of each piece is one of three possible values. The three attributes and values are such that one attribute and value is superior to another attribute and value while also being inferior to the third attribute and value. In the preferred embodiment, three playing pieces of different attributes and different values are stacked to comprise a playing unit. Two players successively compare the attributes and values of the bottom-most pieces of their playing units in a number of plays in order to determine the outcome of the game.

9 Claims, 6 Drawing Figures

GAME PIECES FORMING UNIQUE PLAYING UNITS

CROSS REFERENCE

This application is a continuation-in-part of application Ser. No. 439,179, filed Jan. 7, 1983 now U.S. Pat. No. 4,488,727 for "Board Game Apparatus," the entire disclosure of which is incorporated herein by this reference.

BACKGROUND

This invention relates to a game, and more particularly to a game in which a plurality of playing units are utilized for each of two sides, each of which consists of only one player.

There are a number of games of skill which incorporate playing apparatus which can be employed by two players in a contest to win the game. One type of game employs a plurality of units of playing pieces, with each of the units having three playing pieces of varying strength. The first piece is stronger than the second; the second is stronger than the third; and the third is stronger than the first. A player arranges these pieces in an order unknown to his opponent. In a turn of play, the player and his opponent each uncover one of the pieces of his unit to determine which is stronger. Games of this general nature are shown in Vennor U.S. Pat. No. 4,327,919 and Schaper U.S. Pat. No. 3,048,402. Such a game is fast and easy but requires skill in choosing the correct order of playing pieces in the units in order to win the game. A game of this type is interesting to players of all ages, but can be made more challenging in the manner described with respect to the preferred embodiment disclosed in this application.

SUMMARY

In order to aid in the understanding of this invention, it can be stated in essentially summary form that it is directed to a game apparatus which employs stacked units of playing pieces of different attributes of different strengths. In addition, each attribute has playing pieces of three different values to increase the number of variations in the stacking of playing units.

An object and purpose of my invention is to provide an interesting game characterized by structural simplicity and readily understandable procedural rules, which can be played with or without a game board.

Another object and purpose of my invention is to provide a game which consists of two sets of $n^x$ playing units, in which each of the playing units consists of x playing pieces; each playing piece is coded with symbol which determines the attribute and value of one of the x number of different related groups of attributes. Within each group, there are n members which are assigned a value relative to each other.

A further object and purpose of my invention is to provide a game with playing units that are composed of playing pieces in which the attribute and value of each playing unit can be altered by rearranging the playing pieces. In this way, success in playing the game depends on a combination of chance and the ability to predict the play of the opponent.

Other objects and advantages of the invention may be readily ascertained by referring to the following description and appended illustrations.

DESCRIPTION OF THE PREFERRED EMBODIMENT

Figure 1:
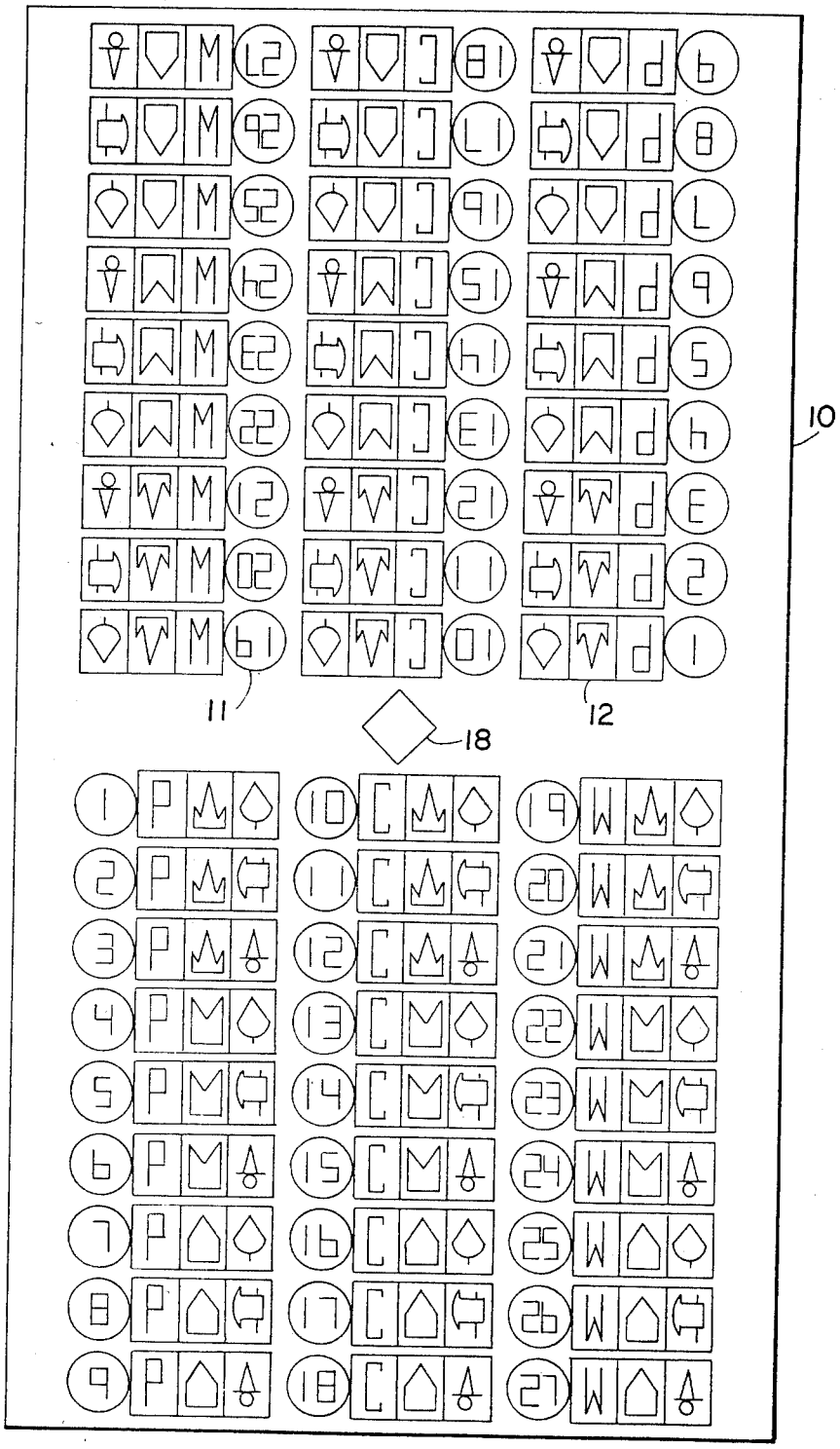
FIG. 1 is a plan view of a playing board which can optionally be used with the playing pieces of this invention.

In the embodiment selected for illustration, FIG. 1 shows the top face of an optional game board 10 which contains twenty-seven circles on each side. The use of the game board is optional with the game pieces of this invention, but FIG. 1 shows the total number of pieces in the preferred embodiment. Each circle 11 contains a number of a whole number series beginning with one and ending with twenty-seven. The three rectangles 12 adjacent each circle 11 show the three coded symbols which correspond to the three playing pieces 51, 52, 53 of a same playing unit 61. The diamond 18 in the center is provided for the playing unit 61 of player who calls the play. The board is optional and is useful in organizing the game. However, the playing pieces described below can be set up and played as a game without the use of the board.

The playing units are each comprised of three separate playing pieces. Each playing piece is marked with one of the nine different symbols. There are three different groups of related symbols, with related group attributes. Each group consists of n members, where n is from 2 to 4, preferably 3, and each member has an assigned value ranging from high to medium to low.

Figure 2:
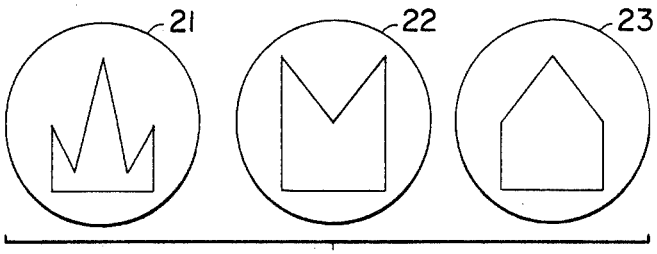
FIG. 2 is a plan view of three playing pieces, each of which is coded with a symbol to present the three members in Group A, namely, the hunters.

The three playing pieces, each with a coded symbol, appearing in FIG. 2 represent the n members of the hunters in Group A. The symbols represent a king 21, a squire 22, and a yeoman 23. Of the three pieces, the king 21 has the highest value. A squire 22 has a higher value than a yeoman 23.

Figure 3:
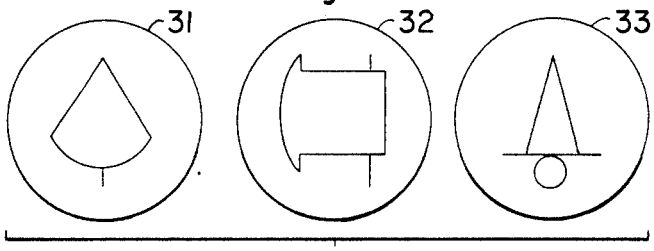
FIG. 3 is a plan view of the three playing pieces, each of which is coded with a symbol to represent the three members in Group B, namely, the weapons.

The three playing pieces, each with a coded symbol, appearing in FIG. 3 represent the n members of the weapons in Group B. The symbols represent a spear 31, an axe 32, and a dagger 33. Of the three pieces, the spear 31 has the highest value. The axe 32 has a higher value than a dagger 33.

Figure 4:
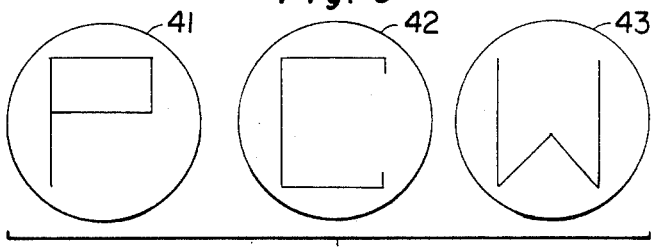
FIG. 4 is a plan view of the three playing pieces, each of which is coded with a symbol to represent the three members in Group C, namely, the animals.

The three playing pieces, each with a coded symbol, appearing in FIG. 4 represent the n members of the animals in Group C. The symbols represent a panther 41, a cheetah 42, and a wolf 43. Of the three pieces, the panther 41 has the highest value. A cheetah 42 has a higher value than a wolf 43.

Figure 5:
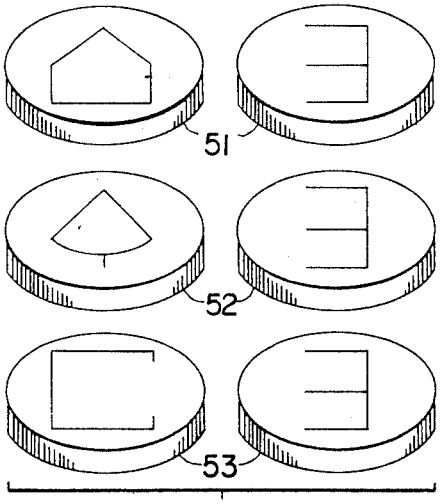
FIG. 5 is a perspective view of an example of the top and bottom of three playing pieces which together comprise one playing unit.
Figure 6:
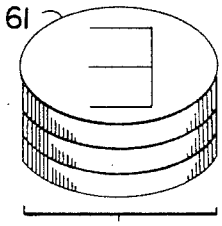
FIG. 6 is a perspective view of an example of one of fifty-four playing units. Each playing unit is comprised of three playing pieces.

The three playing pieces 51, 52, 53 illustrated in FIG. 5 are examples of the components of a playing unit 61, in which the playing unit 61 is illustrated in FIG. 6. A playing unit 61 consists of x playing pieces, where x is from 3 through 4, preferably 3. In the preferred example the playing unit consists of pieces 51, 52, 53. Each playing piece is coded with a symbol to represent its attribute and value. The total number of different pieces is n times x. The x different, related groups of attributes are found in each playing unit 61.

While one side of the playing piece is coded with a symbol to indicate its attribute and value, the piece is also preferably coded with a number. The numbers aid in setting up the pieces into assembled playing units at the beginning of play, but are not necessary. The unit coding number may be on the same or the opposite side as the symbol. Playing pieces 51, 52, 53 of the same playing unit 61 carry a same number, so that players can initially assemble the playing units with correct playing pieces 51, 52, 53. The whole number series, which begins with one and ends with twenty-seven, also serves to help make sure before the beginning of play that all pieces are present.

In the preferred example, there are twenty-seven playing units provided for each of the two players. Since each playing unit 61 consists of three playing pieces 51, 52, 53, each player is provided with a total of eighty-one playing pieces. Since there are three groups of attributes with three members each, there is a total of nine members from the three different, related groups of attributes. Each of the members of the three groups is represented nine times.

The playing pieces are thus arranged with figures thereon of n members in a group and x attributes. This results in a total number of different playing pieces equal to n times x. However, the playing pieces are arranged in units of three, with one piece selected from each group. When n and x are each three, as in the preferred embodiment, there are twenty-seven units each having a different set of playing pieces therein. In playing the game, each of the players has a complete set of units. In more general terms, the complete set of playing pieces for each player comprises $n^x$ units of playing pieces, each made up of x pieces in the unit.

In this game, any one member of the hunters in Group A, which includes the king 21, the squire 22, and the yeoman 23, has an attribute which is superior to any of the members of the weapons in Group B, which includes the spear 31, the axe 32, and the dagger 33. Any one member of the weapons in Group B, which includes the spear 31, the axe 32, and the dagger 33, has an attribute which is superior to any of the members of the animals in Group C, which includes the panther 41, the cheetah 42, and the coyote 43. Furthermore, any one member of the animals in Group C, which includes the panther 41, the cheetah 42, and the coyote 43, has an attribute which is superior to any of the members of the hunters in Group A, which includes the king 21, the squire 22, and the yeoman 23. Thus, the three groups constitute a circular pattern of relationships such that each member of Group A has an attribute superior to any member of Group B, each member of Group B has an attribute superior to any member of Group C, and each member of Group C has an attribute superior to any member of Group A.

The play begins by placing all the playing units with symbols face down. The two opposing players take turns in calling the play, the object of which is to try to capture the opponent's playing unit. Before the play begins, players are allowed to rearrange the playing pieces within each playing unit. The bottom playing piece always determine the attribute and value of the playing unit. Each playing unit 61 may have a different number from one to twenty-seven to aid in initially arranging the pieces.

The first player is the caller. He chooses one of his playing units 61 and determines the attributes of the playing unit 61 by placing the selected playing piece in the bottom downwardly directed position. He places this playing unit in the playing area. Then the caller will pick up at random a playing unit 61 from his opponent's side and hand it to his opponent. The opponent will then rearrange his playing pieces 51, 52, 53 position his selected piece in the bottom downwardly directed position to determine the attribute of his playing unit 61. Once the decision is made, the playing unit 61 is returned to the playing area with the symbol face up. The caller will then have to show the symbol which determines the attribute of his playing unit 61. The two exposed playing pieces are compared for their attributes. The one with the superior attribute wins the playing unit 61. If the attributes are the same, then the playing pieces are compared for their values. The playing piece with the highest value wins. The winner of the play takes possession of the opponent's playing unit 61. If the winner is the caller, he returns his own playing unit 61 to the playing area with the symbol face down. If the winner is the opponent, the opponent returns his playing unit 61 to the playing area with symbol face down. If the two exposed playing pieces are the same, the play results in a draw and both players return their playing units to the playing area with the symbols face down.

On the next play, the opponent becomes the caller and the previous caller becomes the opponent. The same play procedure described above is carried out until one of the players loses all his playing units.

Although the now preferred embodiment of the present invention has been shown and described herein, it is not desired to limit the invention to the exact construction of the playing unit, the groups of attributes, and their members. Accordingly, all suitable modifications and equivalents may be resorted to, including programming the game into a mechanical or electronic game device falling within the scope of the invention as claimed.

What is claimed is:

1. A game comprising:

two sets of twenty-seven playing units, each of said playing units consisting of first, second and third playing pieces, each of said pieces having a first face thereon with said first face carrying a symbol, said symbols being divided into first, second and third groups, each of said groups containing three different symbols and each group containing symbols that are unique with respect to all other groups, said first piece having a symbol selected from the first group of three symbols, said second playing piece having a symbol thereon selected from the second group of three symbols and said third piece having a symbol thereon selected from the third set of three symbols so that each of said units has a unique combination of symbols; and each of said playing pieces having a second face, indicia on said second face, said indicia in each unit being the same and being unique to that unit within its set to aid in maintaining said pieces in playing units.

2. The game of claim 1 wherein said first group, said second group and said third group of symbols each represent different attributes and each group represents an attribute which is superior to the attribute of another group and is inferior to the attribute of the remaining group.

3. The game of claim 2 wherein said first, said second and said third groups of symbols have different values in each group so that in each group a first symbol represents a value superior to a second symbol and the third symbol represents a value inferior to both the first and second symbols.

4. The game of claim 1 wherein said first, said second and said third groups of symbols have three different values in each group so that in each group a first symbol represents a value superior to a second symbol and the third symbol represents a value inferior to both the first and second symbols.

5. A game comprising:

first and second sets of playing units, each of said sets of playing units consisting of $n^x$ number of playing units, each of said playing units being made up of x playing pieces, each of said playing pieces having a first face thereon with said first face carrying a symbol, for each symbol carrying piece in said first set, there being a piece in said second set carrying the same symbol, each piece within a playing unit having a symbol selected from a group consisting of n symbols, the value of x being at least 3; and wherein each of the playing pieces in a playing unit comprises distinguishing means in the form of identical indicia for maintaining the playing pieces within their respective playing units, the indicia of one playing unit being different from the indicia of any other playing unit within a set.

6. The game of claim 5 wherein each of the playing pieces in a playing unit has a second face and said second faces carry said distinguishing means thereon to aid in maintaining those pieces in the playing unit.

7. The game of claim 5 wherein the value of n is selected from the group consisting of the quantities 2, 3 and 4.

8. The game of claim 7 wherein the value of x is 3.

9. The game of claim 8 wherein the value of n is 3.

* * * * *